US009193517B2

(12) United States Patent
Fontana

(10) Patent No.: US 9,193,517 B2
(45) Date of Patent: Nov. 24, 2015

(54) BOTTLE FOR EXTEMPORANEOUS PREPARATION PRODUCTS, PARTICULARLY MEDICAL, PHARMACEUTICAL, COSMETIC PRODUCTS

(75) Inventor: Antonio Fontana, Carpi (IT)

(73) Assignee: LAMEPLAST S.P.A., Novi di Modena (MO) (IT)

( * ) Notice: Subject to any disclaimer, the term of this patent is extended or adjusted under 35 U.S.C. 154(b) by 147 days.

(21) Appl. No.: 14/110,776

(22) PCT Filed: Apr. 4, 2012

(86) PCT No.: PCT/IB2012/000690
§ 371 (c)(1),
(2), (4) Date: Oct. 9, 2013

(87) PCT Pub. No.: WO2012/140484
PCT Pub. Date: Oct. 18, 2012

(65) Prior Publication Data

US 2014/0027322 A1 Jan. 30, 2014

(30) Foreign Application Priority Data

Apr. 11, 2011 (IT) ..... MO2011A0077

(51) Int. Cl.
*B65D 25/08* (2006.01)
*B65D 83/00* (2006.01)
*B65D 51/28* (2006.01)

(52) U.S. Cl.
CPC ..... *B65D 83/00* (2013.01); *B65D 51/2821* (2013.01)

(58) Field of Classification Search
CPC ..... B65D 81/3211; B65D 81/3222; B65D 51/2835
USPC ..... 206/219, 220, 222; 222/80, 145.5, 81
See application file for complete search history.

(56) References Cited

U.S. PATENT DOCUMENTS 4,550,825 A * 11/1985 Sutryn et al. ..... 206/222
4,580,682 A * 4/1986 Gorski et al. ..... 206/569

(Continued)

FOREIGN PATENT DOCUMENTS

DE 10 2006 055083 B3 5/2008
EP 0 963 325 B1 11/2001

(Continued)

OTHER PUBLICATIONS

International Search Report, dated Sep. 19, 2012, from corresponding PCT application.

*Primary Examiner* — Luan K Bui
*Assistant Examiner* — Rafael Ortiz
(74) *Attorney, Agent, or Firm* — Young & Thompson

(57) ABSTRACT

A bottle for extemporaneous-preparation products includes: a tank for containing a first substantially liquid substance, which has at least a dispensing mouth; and a container for containing a second substantially powdery substance associable with the tank substantially in proximity of the dispensing mouth, the inner volume of the container being temporarily separated from the inner volume of the tank and arranged to communicate therewith for mixing the first and second substances to form a product. The container includes a blistered capsule having: a first foil substantially deformable and shaped to define a containment cavity of the second substance; and a second foil substantially breakable, which is associated with the first foil to close the containment cavity and is turned towards the dispensing mouth, wherein applying pressure on the first foil causes the breaking of the second foil for the outflow and mixing of the first and of second substances.

21 Claims, 6 Drawing Sheets

(56) References Cited

U.S. PATENT DOCUMENTS

| | | | | |
|---|---|---|---|---|
| 6,230,884 | B1 * | 5/2001 | Coory | 206/222 |
| 2002/0179461 | A1 * | 12/2002 | Mollstam et al. | 206/222 |
| 2004/0011679 | A1 | 1/2004 | Vlodek | |
| 2007/0045134 | A1 * | 3/2007 | Dvorak et al. | 206/222 |
| 2009/0261000 | A1 * | 10/2009 | Epp et al. | 206/222 |
| 2010/0308050 | A1 * | 12/2010 | Gassner | 220/266 |

FOREIGN PATENT DOCUMENTS

| | | | |
|---|---|---|---|
| EP | 1 186 548 | A2 | 3/2002 |
| EP | 1 858 774 | B1 | 11/2007 |
| GB | 2 466 187 | A | 6/2010 |
| WO | 98/00348 | A1 | 1/1998 |
| WO | 00/53507 | A1 | 9/2000 |
| WO | 02/092440 | A2 | 11/2002 |

* cited by examiner

Fig. 1
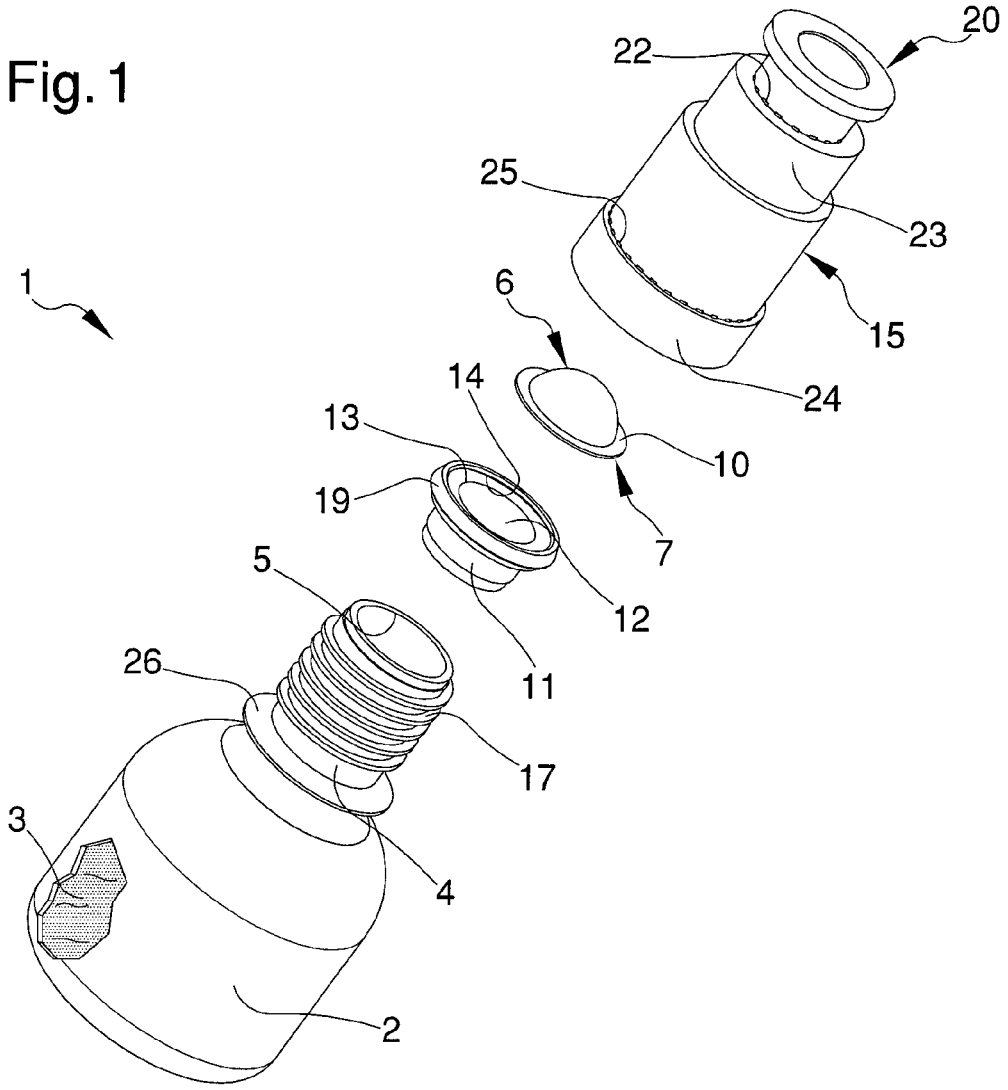
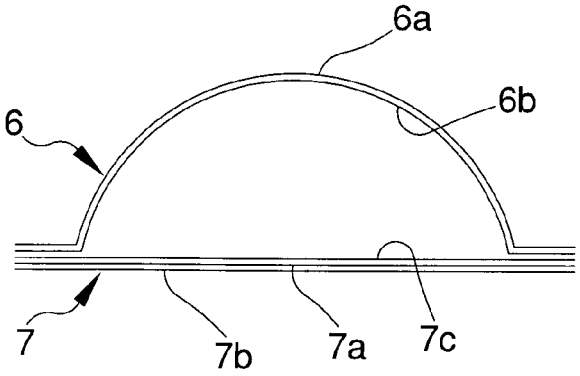
Fig. 2

BOTTLE FOR EXTEMPORANEOUS PREPARATION PRODUCTS, PARTICULARLY MEDICAL, PHARMACEUTICAL, COSMETIC PRODUCTS

TECHNICAL FIELD

The present invention relates to a bottle for extemporaneous-preparation products, particularly medicinal, pharmaceutical, cosmetic, dietary products or the like.

BACKGROUND ART

In the medicinal sector, in the pharmaceutical sector, in the cosmetic sector or in that of dietary supplements, extemporaneous-preparation products are known, i.e., products made up of the solution or of the mixing of at least two different substances, of which, e.g., one in the liquid state and the other in the powder state, which are kept separate the one from the other until the time of use.

For the packaging of extemporaneous-preparation products the use is known of bottles such as those described and illustrated in the patent document EP 0 963 325.

Such bottles are essentially made up of a tank which is closed on the bottom and which extends at the top in a neck, at the top of which is defined a dispensing mouth; inside the tank a first substance is contained, generally in the liquid state.

In the mouth of the tank is housed a container of a second substance which is made up of a hollow cylindrical body closed at the bottom by a breakable bottom and open at the top; the bottom of the container, as long as this remains intact, separates the second substance from the first.

Inside the container is inserted, sealed, a cutting member made up of a tubular body, the lower extremity of which is sectioned according to an oblique plane or which is bevel shaped and the upper extremity of which extends beyond the top opening of the container.

The cutting member is axially sliding with respect to the container between a non-interference configuration, wherein it is placed above the intact bottom of the container itself, and a cutting configuration, wherein, pushed towards the bottom of the container, it cuts this along the perimeter edge putting the container, thus opened, into communication with the tank.

The known bottles, furthermore, have a cover cap which is associated with the neck of the tank by means of a threaded coupling; the lower edge of the cap is temporarily secured, along a breakage line, to a seal ring secured to the neck of the tank and having a weakened axial line in correspondence to which it opens.

Finally, inside the cap, an annular relief is defined which, after the cap has been screwed onto the neck of the tank, couples with the upper edge of the container, which is elastically deformable in a centripetal direction, to form a single body piece with this.

At the time of using the product, the cap is screwed onto the neck of the tank to break the seal ring which detaches from this and opens. The screwing up of the cap causes the sliding of the cutting member inside the container until the bottom of the latter is cut; the second substance is then poured from the container into the tank, inside which it mixes with the first to form the product. To dispense the product thus formed, the cap has simply to be unscrewed to also remove, integral with this, the container and the cutting member opening the dispensing mouth of the tank.

These bottles of known type are not without drawbacks, among which should be recalled the fact that, though keeping the two substances separate until the preparation of the product, they do not permit completely isolating the one with respect to the other.

In particular, the vapours coming from the outside environment and/or those released by the liquid substance in the tank permeate, in part, inside the container where a powdery, often hygroscopic substance is generally present. Before the preparation of the product, when the two substances are still separated, the powdery substance absorbs the vapours released by the liquid substance impregnating itself with these and becoming dense in agglomerates. When, at the time of preparing the product, the container is opened and placed in communication with the tank, the agglomerates which have formed tend to remain inside the container and, even when they have been poured into the tank, they have difficulty in dissolving and dispersing themselves completely in the liquid substance.

The composition of the product thus formed does not correspond to that provided for it; in the event of the product being a drug or a medicinal, this causes an indeterminable alteration of the contents of its active ingredients and of the dosage established for it and, therefore, a disadvantageous modification of the therapy studied for a patient.

Such drawback is accentuated by the fact that the containers of known bottles are generally made of polymer materials which have a certain degree of permeability to vapours.

Permeability to vapours is further accentuated in correspondence to the bottom of the container which, being of a breakable type, generally has a reduced thickness and/or is fastened to the member of the container along weakened lines of even more reduced thickness.

To overcome such drawbacks at least in part, bottles are known like those illustrated in the documents EP 1 186 548 and EP 1 858 774, wherein the container containing the second substance defines an insulating interspace to hinder the transit of the vapours released by the liquid substance.

In any case, these bottles are not exempt from drawbacks either.

Recent studies have shown that the presence of an insulating interspace can only delay the diffusion of the vapours released by the liquid substance and, therefore, not prevent their absorption by the powdery substance and the formation of inconvenient agglomerates.

DESCRIPTION OF THE INVENTION

The main aim of the present invention is to provide a bottle for extemporaneous-preparation products, particularly medicinal, pharmaceutical, cosmetic products or the like, which does in fact allow maintaining the substances making up the product perfectly separate from one another and isolated until the time of product preparation.

The object of the present invention consists in providing a bottle which allows, in particular, preventing the absorption by a substance, generally a powdery and hygroscopic one, of the vapours released by another, generally liquid and, therefore, the formation of undesired thickening and agglomerates.

A further object of the present invention consists in providing a bottle that allows preparing a product of required composition and, therefore, in the particular case of medicinal or pharmaceutical products, with a preset content of active ingredients, thus making it possible to comply with the dosage established for the therapy of a patient.

Another object of the present invention consists in providing a bottle which can be used and opened in a simple, practical and easy way by users without requiring any particular effort on their part.

Not the least object of the present invention consists in providing a bottle the costs and production times of which are reduced, which is easy to assemble and which permits limiting the quantities of construction materials used for its production.

Another object of the present invention is to provide a bottle for extemporaneous-preparation products, particularly medicinal, pharmaceutical, cosmetic products or the like that allows overcoming the mentioned drawbacks of the state of the art within the ambit of a simple, rational, easy and effective to use as well as low cost solution.

The above mentioned objects are achieved by the present bottle for extemporaneous-preparation products, particularly medicinal, pharmaceutical, cosmetic products or the like, comprising:

at least a tank for the containment of a first substance substantially liquid, which has at least a dispensing mouth; and at least a container for the containment of a second substance substantially in powder associable with said tank substantially in proximity of said dispensing mouth, the inner volume of said container being temporarily separated from the inner volume of said tank and suited to be put in communication with it for mixing the first substance and the second substance to form a product, characterized in that said container comprises a blistered capsule having:

a first foil substantially deformable and shaped to define a containment cavity of said second substance; and a second foil substantially breakable, which is associated with said first foil to close said containment cavity and is turned towards said dispensing mouth, the application of a pressure on said first foil determining the breaking of said second foil for the outflow and mixing of the first substance and of the second substance to form said product.

BRIEF DESCRIPTION OF THE DRAWINGS

Other characteristics and advantages of the present invention will become more evident from the description of some preferred, but not sole, embodiments of a bottle for extemporaneous-preparation products, particularly medicinal, pharmaceutical, cosmetic products or the like, illustrated purely as an example but not limited to the annexed drawings in which:

FIG. 1 is an exploded view of a preferred embodiment of the bottle according to the invention;

FIG. 2 is a section view, on enlarged scale, of the container used in the bottle of FIG. 1;

EMBODIMENTS OF THE INVENTION

Figure 3:
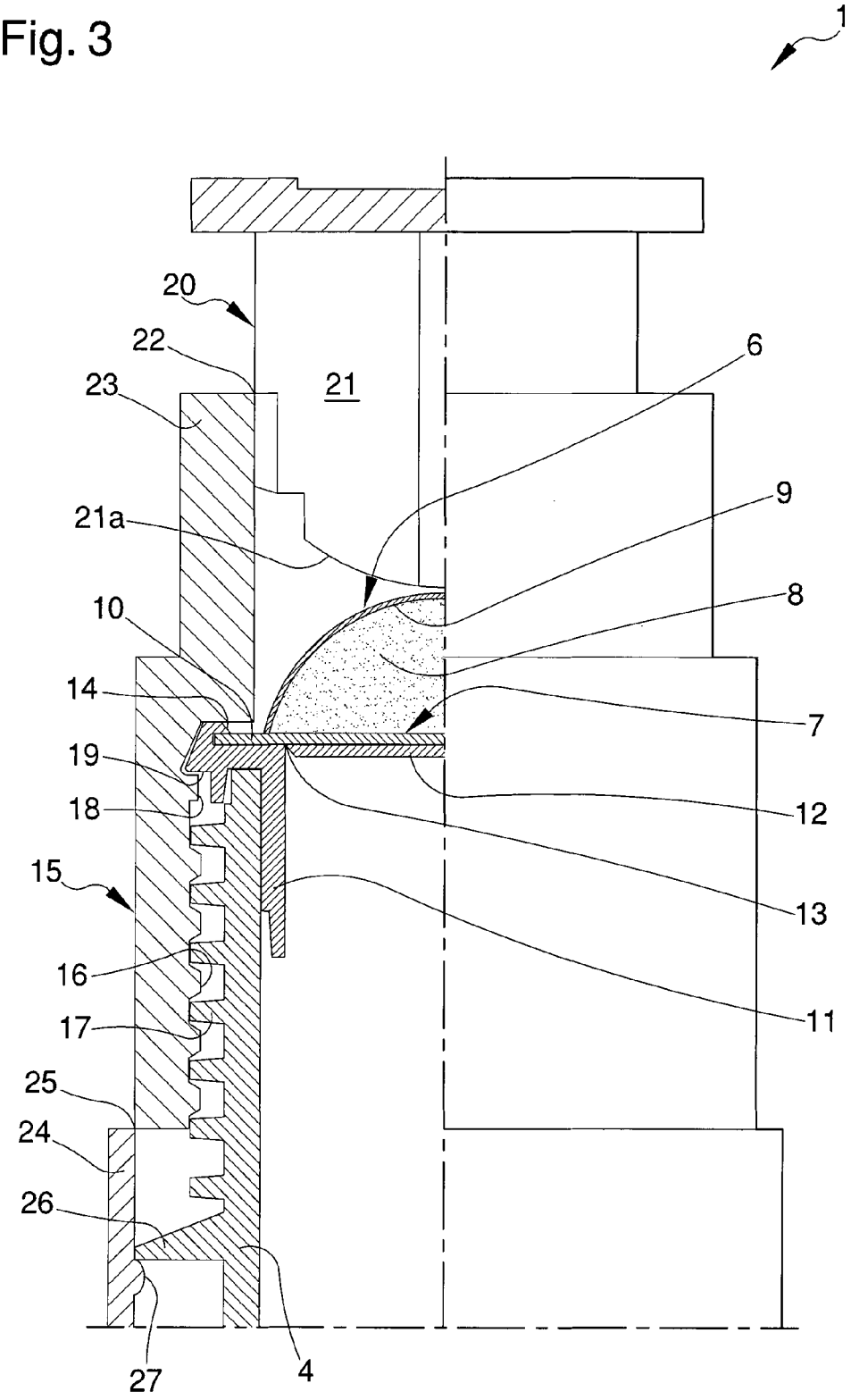
FIG. 3 is a section view, on enlarged scale, of a detail of the bottle of FIG. 1 in a packaging configuration.

With particular reference to the embodiment of the Figures from 1 to 6, globally indicated by 1 is a bottle for extemporaneous-preparation products, particularly medicinal, pharmaceutical, cosmetic products or the like.

By extemporaneous-preparation products are meant products obtainable through the solution or the mixing of at least two different substances which are kept separate until the time of product use.

One of the two substances is generally in powder or granular form, while the other is generally in liquid state.

In particular, the bottle 1 comprises a tank 2 for containing a first substantially liquid substance 3 which has a substantially bottle shape and is closed on the bottom and extends upwards to form a neck 4, at the top of which a dispensing mouth 5 is defined to allow the product to come out once it has been prepared. With the tank 2, in the proximity of the dispensing mouth 5, is associated a container 6, 7 for containing a second substantially powdery substance 8, wherein the internal volume of the container 6, 7 is temporarily separated from the internal volume of the tank 2 and is suitable for being placed in communication with this to mix the first and the second substance to form the product.

The container 6, 7 is made up of a blistered capsule having:

a first foil 6 substantially deformable and shaped to define a containment cavity 9 of the second substance 8; and a second foil 7 substantially breakable, which is associated with the first foil 6 to close the containment cavity 9 and is turned towards the dispensing mouth 5, the application of a pressure on the first foil 6 determining the breakage of the second foil 7 for the escape and mixing of the first substance 3 and of the second substance 8 to form the product.

More in detail, the first foil 6 is substantially curved and has an edge 10 with which is associable the second foil 7 which, instead, is substantially flat.

At least one between the first foil 6 and the second foil 7 comprises at least one layer of aluminium able to prevent the transit of humidity and, above all, any vapours escaping from the first substance 3.

Preferably, both the first foil 6 and the second foil 7 each have a foil of aluminium, if necessary combined with one or more layers of other material.

In the particular embodiment shown in FIG. 2, e.g., the blistered capsule 6, 7 comprises a first foil 6 composed of an outer layer of aluminium 6*a* superimposed on an inner layer of plastic 6*b* (e.g., polyethylene), and a second foil 7 made up of an intermediate layer of aluminium 7*a* placed between an outer layer 6*b* and an inner layer 6*c* of plastic (e.g., polyethylene again); the layers of aluminium 6*a*, 7*a* and of plastic 6*b*, 7*b*, 7*c* are made integral with one another, e.g. by gluing or welding.

The bottle 1 also comprises a bush 11, which can be fitted over the dispensing mouth 5 and in part inside this and supports the blistered capsule 6, 7.

The bottle 1 also comprises a closing member 12 for closing the dispensing mouth 5, which is suitable for separating the blistered capsule 6, 7 from the inner volume of the tank 2 and is breakable or removable when the second foil 7 is broken.

The closing member 12 is composed, for example, of a partition wall secured to the perimeter of the bush 11 along a line with weakened section 13 intended to be broken when the second foil 7 is broken.

In practice, as long as the partition wall 12 keeps the dispensing mouth 5 closed, the closing member 12 prevents the first substance 3 from coming out of the tank 2 and prevents the surface of the blistered capsule 6, 7 from being wetted by the first substance 3.

This characteristic represents a further guarantee for the correct preservation of the second substance 8 inside the blistered capsule 6, 7, which is already impermeable to the first substance 3 by virtue of the presence of the aluminium layers 6*a*, 7*a* in the first foil 6 and in the second foil 7.

To this must be added that the closing member 12 ensures that the first foil 6 and the second foil 7 always remain substantially dry and, when the second foil 7 is broken, it prevents any drops of first substance 3 on the surface of the blistered capsule 6, 7 from aggregating the second substance 8 and preventing its falling inside the tank 2.

For the correct positioning of the container 6, 7, the bottle 1 comprises interlocking means 14 for retaining the blistered capsule 6, 7 in the proximity of the dispensing mouth 5.

The interlocking means 14 are composed, e.g., of an interlocking projection that protrudes from the bush 11 on the opposite side with respect to the tank 2 and is suitable for retaining the edge 10 of the blistered capsule 6, 7.

Once secured on the tank 2, the blistered capsule 6, 7 has the second foil 7 in contact with the partition wall 12 while the first foil 6 extends with its curvature turned on the other side with respect to the tank 2 and the dispensing mouth 5. To cover the dispensing mouth 5 and the blistered capsule 6, 7, the bottle 1 has a removable cap 15 which can be associated with the neck 4 of the tank 2.

More in detail, the cap 15 can be associated with the tank 2 by means of a threaded coupling 16, 17: the inner surface of the cap 15 in fact has a nut screw 16 which can be screwed on an external threading 17 obtained on the neck 4.

Furthermore, the cap 15 has joining means 18, 19 which permit connecting it stably to the bush 11.

The joining means 18, 19 comprise a retention tooth 18 obtained on the inner surface of the cap 15 and an interlocking projection 19 which protrudes from the bush 11 and which has a tapered invitation profile which makes it easier for the retention tooth 18 to slot in.

The joining of the retention tooth 18 and the interlocking projection 19 occurs once the screwing up of the cap 15 has been completed.

To allow opening the blistered capsule 6, 7 and allow the second substance 8 to come out, the bottle 1 has a pressing member 20 moving between a packaging configuration, wherein the pressing member 20 is kept substantially away from the blistered capsule 6, 7, and a release configuration, wherein the pressing member 20 is arranged in contact against the first foil 6 for the breakage of the second foil 7.

For this purpose, the pressing member 20 comprises a series of breaking ribs 21 having a useful breaking profile 21*a*, i.e., an edge meant to come into contact with the first foil 6 of the blistered capsule 6, 7, which is substantially curved, with curvature substantially opposite to the curvature of the first foil 6.

More in detail, the pressing member 20 and the cap 15 are made in a single monolithic body and are joined along a pre-breaking line 22 which is breakable for the switch of the pressing member 20 from the packaging configuration to the release configuration.

In other words, the pressing member 20 and the cap 15 are made joined and, once the cap has been placed on the neck 4 of the tank 2, the pressing member 20 remains far enough from the blistered capsule 6, 7 so as not to negatively affect its integrity.

To open the blistered capsule 6, 7, a pressure must be applied on the pressing member 20 such as to break the pre-breaking line 22 and bring the pressing member 20 closer to the blistered capsule 6, 7.

To make this operation easier, the cap 15 has a guide section 23, with a substantially cylindrical tubular shape, in which the pressing member 20 can be inserted after the breakage of the pre-breaking line 22 to guide it from the packaging configuration to the release configuration.

Furthermore, the bottle 1 comprises anti-tampering seal means 24 suitable for evidencing the removal of the cap 15 from the tank 2.

The anti-tampering seal means 24 comprise a seal ring which is made in a single monolithic body with the cap 15 along a tearable line 25 and which can be secured to the tank 2 by means of an interlocking coupling when the cap 15 is completely screwed onto the neck 4.

Such coupling is made up, e.g., of an annular relief 26 protruding from the outer surface of the neck 4 and of a corresponding annular protrusion 27 defined inside the seal ring 24.

The operation of the bottle shown in the figures from 1 to 6 is the following.

The bottle is fabricated in the form of four separate component parts (FIG. 1): the tank 2 containing the first substance 3, the blistered capsule 6, 7 containing the second substance 8, the cap 15, which integrates the pressing member 20 and the seal ring 24, and the bush 11, which integrates the closing member 12 and the interlocking means 14.

The assembly of the bottle 1 is done by slotting the blistered capsule 6, 7 in the interlocking projection 14 associated with the bush 11 and subsequently fitting the bush 11 in the dispensing mouth 5.

The cap 15 is then fitted and screwed onto the neck 4; once screwing on has been completed, the retention tooth 18 couples stably with the interlocking projection 19, making the bush 11 integral with the cap 15, while the annular protrusion 27 of the seal ring 24 couples with the annular relief 26, securing itself to the tank 2.

In this packaging configuration (FIG. 3) the blistered capsule 6, 7 remains separate from the tank 2 thanks to the presence of the partition wall 12.

When the product has to be prepared, all the user has to do is apply a pressure on the pressing member 20 such as to break the pre-breaking line 22 and thus release the pressing member 20 from the cap 15.

Along the guide section 23, the pressing member 20 is made to switch from the packaging configuration to the release configuration, in which it comes into contact with the blistered capsule 6, 7, deforming its first foil 6.

The pressure applied on the second substance 8 by means of the deformation of the first foil 6 leads to the breaking of the second foil 7 and to the at least partial breakage of the weakened section line 13.

Figure 4:
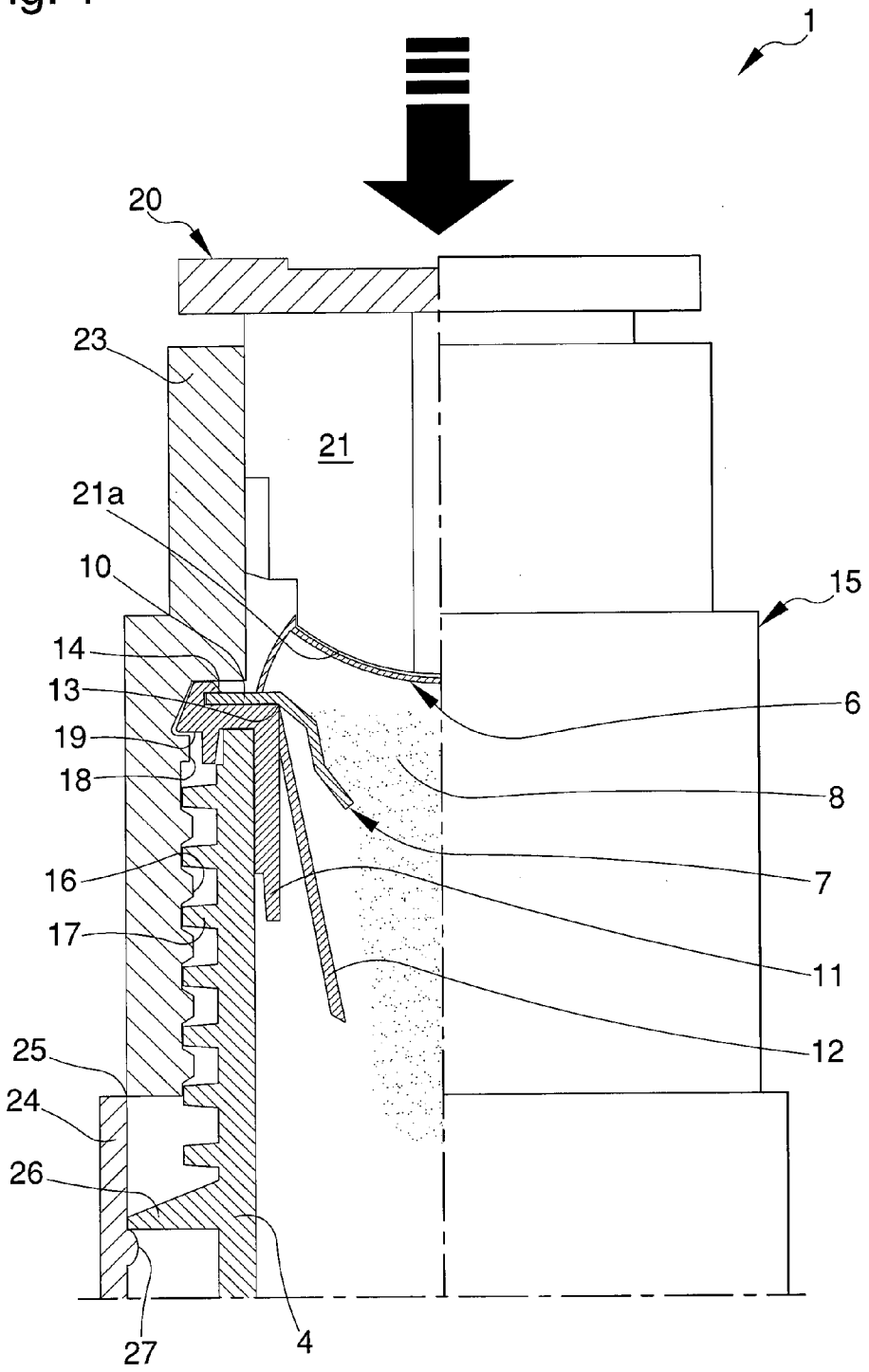
FIG. 4 is a section view, on enlarged scale, of the detail of FIG. 3 in a release configuration.

More in particular, the partition wall 12 remains secured along a section of its perimeter to the edge of the bush 11, but this is in any case enough to allow the drop by gravity of the second substance 8 through the dispensing mouth 5 and its pouring inside the tank 2 to form the product (FIG. 4).

To dispense the product prepared this way, the cap 15 simply has to be unscrewed from the neck 4.

This operation determines the contemporaneous removal of the bush 11 and of the blistered capsule 6, 7, which are reciprocally interlocked onto the cap 15.

Figure 5:
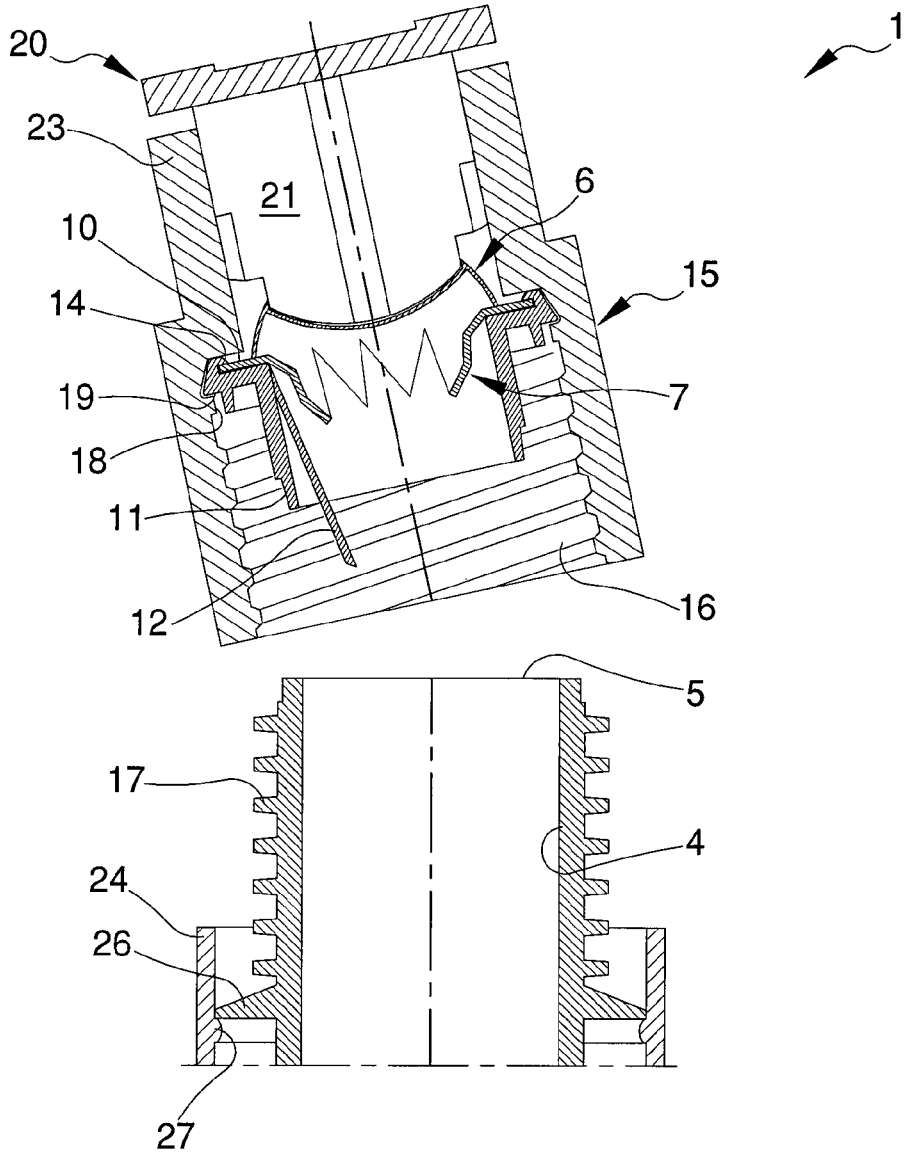
FIG. 5 is a section view, on enlarged scale, of the detail of FIG. 3 in an opening configuration.
Figure 6:
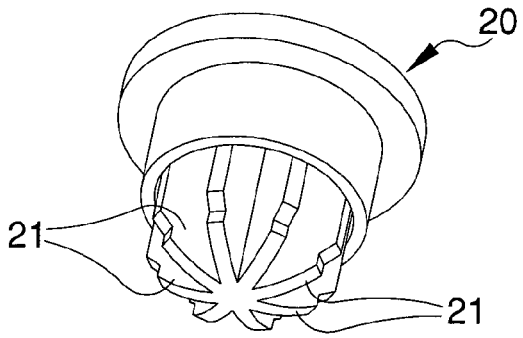
FIG. 6 is an axonometric view of the pressing member used in the bottle of FIG. 1.

When the cap 15 is removed, furthermore, the coupling between the seal ring 24 and the tank 2 remains steady while that between the seal ring 24 and the cap 15 gives way; the tearable line 25, does in fact break, the cap 15 is removed while the seal ring 24 stays on the neck 4 to indicate the bottle 1 has been opened (FIG. 5).

Figure 7:
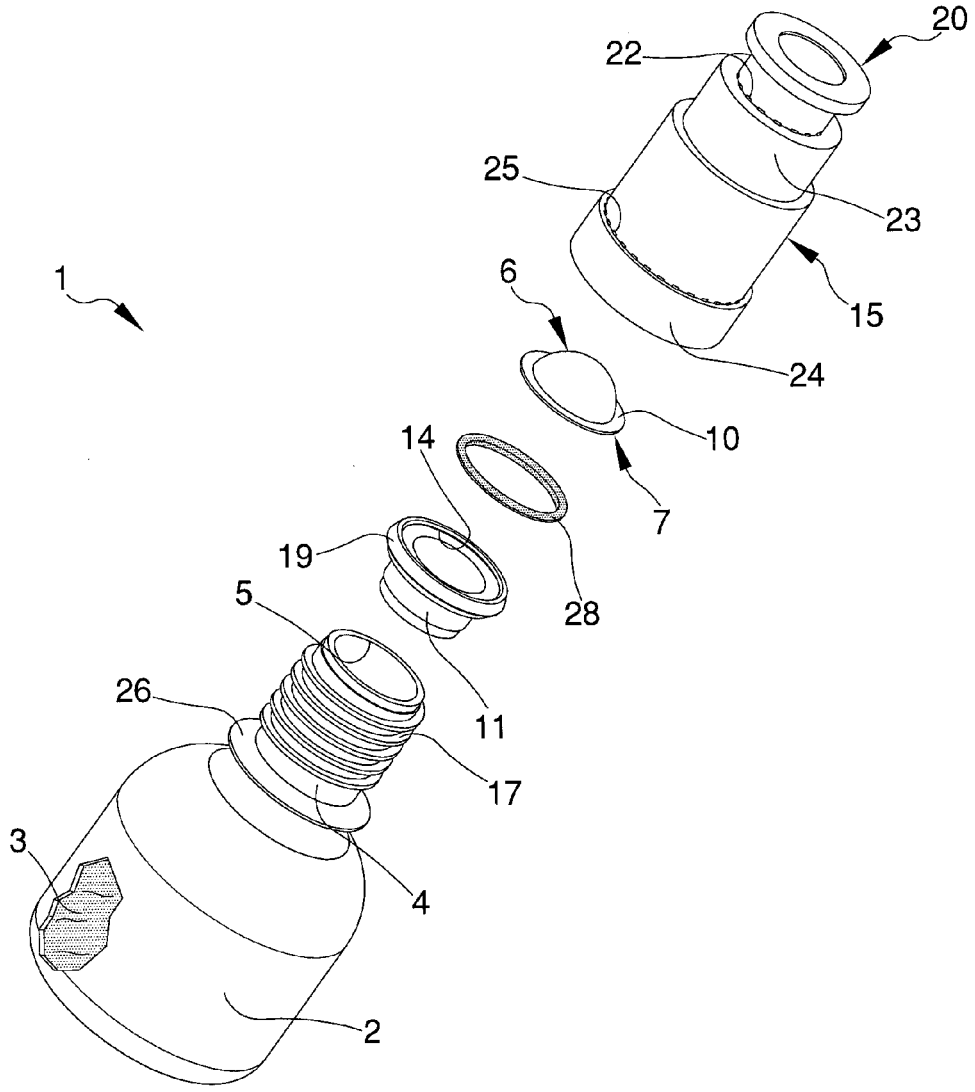
FIG. 7 is an exploded view of an alternative embodiment of the bottle according to the invention.
Figure 8:
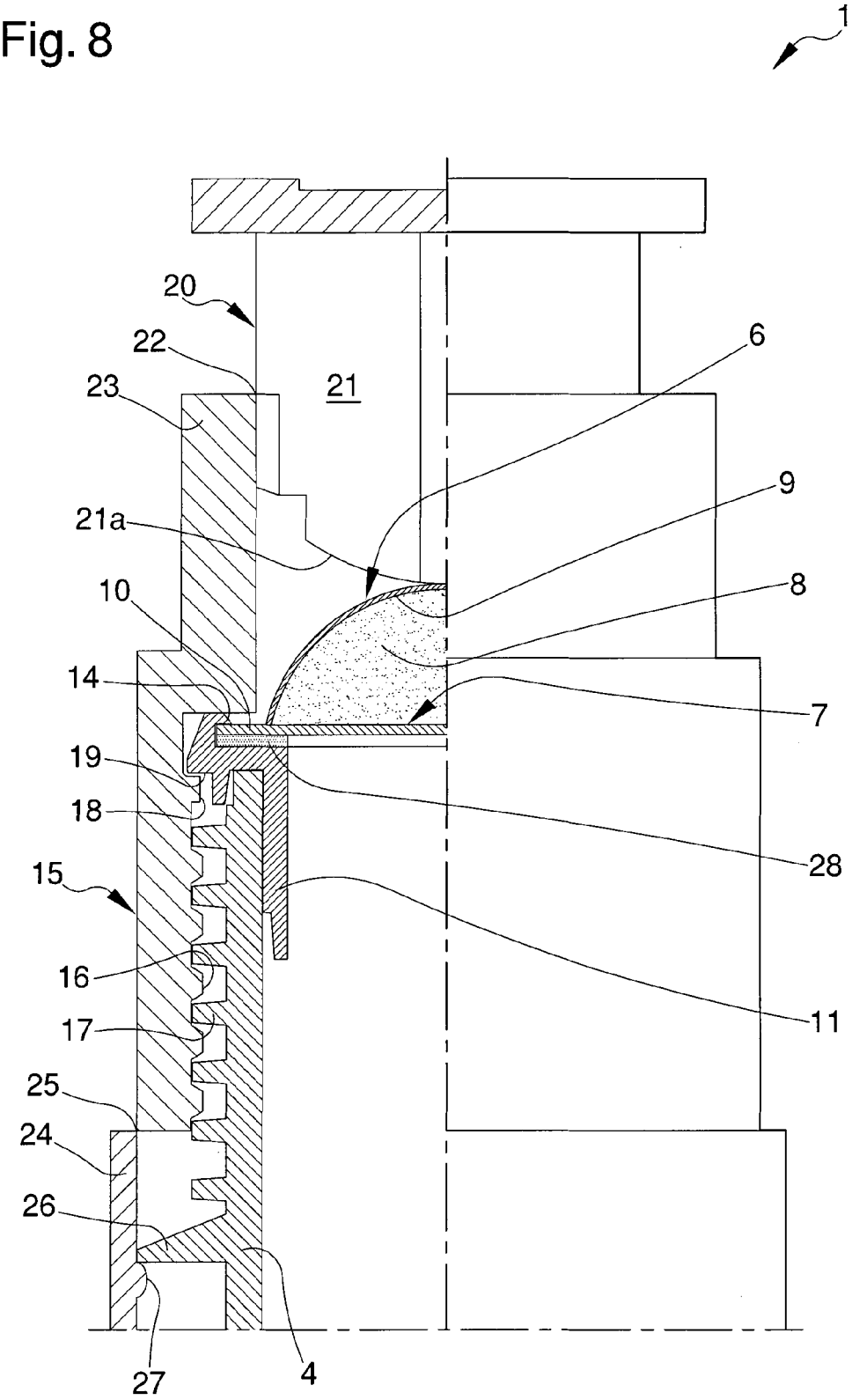
FIG. 8 is a section view, on enlarged scale, of a detail of the bottle of FIG. 7 in a packaging configuration.

In the FIGS. 7 and 8, an alternative embodiment of the invention is shown in which the bottle 1 has a tank 2, a blistered capsule 6, 7 and a cap 15 substantially identical to those of the embodiment of the figures from 1 to 6, for which, therefore, reference is made to what was said and shown above.

The bottle 1 also has a bush 11 similar to that of the previous embodiment, except for the fact that no closing member 12 is provided, the bush 11 being open at both extremities.

In addition, the bottle 1 of the FIGS. 7 and 8 has gasket means 28 that can be placed between the bush 11 and the blistered capsule 6, 7.

Such gasket means 28, e.g., consist of a more or less elastic ring fittable on the bush 11 and meant to stay interlocked between the bush 11 and the blistered capsule 6, 7 once the edge 10 has been fitted in the interlocking means 14.

In practice, the gasket means 28, in the absence of the partition wall 12, prevent the first substance 3 from coming out of the dispensing mouth 5 by seeping between the bush 11 and the blistered capsule 6, 7, so as to avoid this inconveniently ending up inside the cap 15.

The operation of the bottle 1 shown in the FIGS. 7 and 8 is the following.

The bottle 1 is fabricated in the form of five separate components: the tank 2, the blistered capsule 6, 7, the cap 15, the bush 11 and the gasket means 28 (FIG. 7).

The assembly of the bottle 1 occurs by interlocking the gasket means 28 and the edge 10 of the blistered capsule 6, 7 in the interlocking projection 14 associated with the bush 11 and subsequently fitting the bush 11 in the dispensing mouth 5. The cap 15 is then fitted and screwed onto the neck 4 until the packaging configuration (FIG. 8) is achieved, in which, in the absence of the partition wall 12, the blistered capsule 6, 7 directly faces onto the tank 2.

The operation of the bottle 1 is therefore substantially identical to that shown in the figures from 1 to 6: when the product has to be prepared, the user applies a pressure on the pressing member 20, switching from the packaging configuration to the release configuration and determining the breakage of the second foil 7, which allows the drop by gravity of the second substance 8 through the dispensing mouth 5 and the formation of the product; the subsequent removal of, the cap 15 from the neck 4, besides opening the bottle 1, at the same time allows removing the bush 11, the blistered capsule 6, 7 and the gasket means 28.

The bottle 1 previously described and shown in the illustrations is susceptible to numerous changes and variations.

In this respect, it must be underlined that the bottle 1 could if necessary also comprise a rigid protection plug, to be positioned around the cap 15 to prevent, during transport, the pressing member 20 being accidentally subject to knocks or direct shocks that could determine the breakage of the prebreaking line 22 and the switch from the packaging configuration to the release configuration before actual use by the end user.

In both the embodiments shown in the FIGS. 1-6 and 7-8, furthermore, the interlocking means 14 consist, as has been said, in an interlocking projection protruding from the bush 11 for the retention of the edge 10 of the blistered capsule 6, 7; alternative embodiments cannot however be ruled out wherein, e.g., the interlocking projection is obtained inside the cap 15 or wherein the retention of the blistered capsule 6, 7 occurs by crushing the edge 10 between a surface of the cap 15 and a corresponding surface of the bush 11 which occurs when the screwing up of the cap 15 has been completed.

It has in practice been ascertained how the described invention achieves the proposed objects.

The present bottle does in fact allow maintaining the substances making up the product separate and perfectly isolated until the time when the product has to be prepared.

The use of a blistered capsule does in fact allow perfectly isolating the second substance from the first as long as these are separated the one from the other.

The bottle according to the invention, thus prevents the second substance from absorbing the vapours released by the first substance, avoiding the formation of thickening and agglomerates and guaranteeing the complete dissolution of the one in the other.

The bottle according to the invention thus guarantees the preparation of a product of desired composition and, in the particular case of medicinal or pharmaceutical products, having a prefixed content of active ingredients, thus making it possible to keep to the dosage indicated for a patient's therapy.

Finally, the bottle according to the invention is practical and easy to use by users and does not require any particular effort on their part.

The invention claimed is:

1. A bottle (1) for extemporaneous-preparation products, particularly medicinal, pharmaceutical, cosmetic products or the like, comprising:

at least a tank (2) with an inner volume for containment of a first substance (3) substantially liquid, which tank has at least a dispensing mouth (4);

at least a container (6, 7) with a containment cavity that contains a second substance (8) substantially in powder, said at least a container (6, 7) associable with said tank (2) substantially in proximity of said dispensing mouth (4), the containment cavity of said container (6, 7) being temporarily separated from the inner volume of said tank (2), said at least a container (6, 7) being suited to be put in communication with the dispensing mouth (4) of said tank (2) for mixing the first substance (3) and the second substance (8) to form a product, wherein said container (6, 7) comprises a blistered capsule having:

a first foil (6) substantially deformable, a shape of the first foil (6) defining a shape of the containment cavity (9) of said second substance (8); and a second foil (7) substantially breakable, which is associated with said first foil (6) to close said containment cavity (9) and is turned towards said dispensing mouth (4), an application of a pressure on said first foil (6) determining breaking of said second foil (7) for outflow and mixing of the first substance (3) and of the second substance (8) to form said product;

at least a pressing member (20) moving between i) a packaging configuration, wherein said pressing member (20) is kept substantially at a distance from said blistered capsule (6, 7), and ii) a release configuration, wherein said pressing member (20) is arranged in contact against said first foil (6) for breaking said second foil (7);

a removable cap (15) associable with said tank (2), said removable cap (15) covering said dispensing mouth (4) and said blistered capsule (6, 7);

at least a bush (11) fitted onto or into said dispensing mouth (4); and a joining element (18, 19) that connects stably said cap (15) to said bush (11).

2. The bottle (1) according to claim 1, wherein said first foil (6) is substantially curved and said second foil (7) is substantially flat.

3. The bottle (1) according to claim 1, wherein:

said first foil (6) is substantially curved and said second foil (7) is substantially flat; and said pressing member (20) comprises a series of breaking ribs (21) having a useful breaking profile (21*a*) substantially curved with a curve substantially opposite the curve of said first foil (6).

4. The bottle (1) according to claim 1, wherein said cap (15) is associable with said tank (2) with a threaded coupling.

5. The bottle (1) according to claim 1, wherein said pressing member (20) and said cap (15) are made in a single body piece.

6. The bottle (1) according to claim 5, wherein said pressing member (20) and said cap (15) are joined together along a pre-breaking line (22) which can be broken for the switch of said pressing member (20) from said packaging configuration to said release configuration.

7. The bottle (1) according to claim 1, wherein said cap (15) comprises at least a guide section (23), and wherein said pressing member (20) can be inserted in the cap so that the guide section guides the pressing member from said packaging configuration to said release configuration.

8. The bottle (1) according to claim 1, wherein said bottle (1) comprises at least a bush (11) that can be fitted onto or into said dispensing mouth (4).

9. The bottle (1) according to claim 1, wherein said bottle (1) comprises at least a closing member (12) for closing said dispensing mouth (4), which closing member (12) is suitable for separating said blistered capsule (6, 7) from the inner volume of said tank (2) and is breakable or removable when breaking said second foil (7).

10. The bottle (1) according to claim 9, wherein:

said bottle (1) comprises at least a bush (11) that can be fitted onto or into said dispensing mouth (4); and said closing member (12) comprises at least a partition wall fastened to the perimeter of said bush (11) along a weakened section line (13).

11. The bottle (1) according to claim 1, wherein said bottle (1) comprises an interlocking element (14) that retains said blistered capsule (6, 7) in proximity of said dispensing mouth (4).

12. The bottle (1) according to claim 11, wherein:

said bottle (1) comprises at least a bush (11) that can be fitted onto or into said dispensing mouth (4); and said interlocking element (14) comprises at least an interlocking projection associated with said bush (11).

13. The bottle (1) according to claim 1, wherein said joining element (18, 19) comprise at least a retention tooth (18) obtained on an inner surface of said cap (15) and at least an interlocking projection (19) which protrudes from said bush (11).

14. The bottle (1) according to claim 13, wherein at least one between said retention tooth (18) and said interlocking projection (19) has a flared invitation profile suitable for facilitating the insertion of the other between said retention tooth (18) and said interlocking projection (19).

15. The bottle (1) according to claim 1, wherein said cap (15) comprises an anti-tampering seal (24) that evidences removal of said cap (15) from said tank (2).

16. The bottle (1) according to claim 15, wherein said anti-tampering seal (24) comprises a seal ring which is made in a single body piece with said cap (15) along a tearable line (25) and which can be secured to said tank (2).

17. The bottle (1) according to claim 8, wherein said bottle (1) further comprises a gasket (28) placed between said bush (11) and said blistered capsule (6, 7).

18. The bottle (1) according to claim 1, wherein said first foil (6) comprises at least an aluminium layer (6*a*).

19. The bottle (1) according to claim 1, wherein said second foil (7) comprises at least an aluminium layer (7*a*).

20. A bottle (1) for extemporaneous-preparation products, including medicinal, pharmaceutical, and cosmetic, comprising:

a tank (2) with an inner volume for containment of a substantially liquid, first substance (3), the tank having a dispensing mouth (4);

a container (6, 7) with a containment cavity that contains a substantially powder, second substance (8) substantially in powder, said container (6, 7) associable with said mouth of said tank (2) with the containment cavity of said container (6, 7) being temporarily separated from the inner volume of said tank (2), said container (6, 7) being suited to be put in communication with the dispensing mouth (4) of said tank (2) for mixing the first substance (3) and the second substance (8) to thereby form a product, wherein said container (6, 7) further comprises a blistered capsule having:

a first foil (6) substantially deformable, a shape of the first foil (6) defining a shape of the containment cavity (9) of said second substance (8), and a second foil (7) substantially breakable, the second foil (7) being associated with said first foil (6) to close said containment cavity (9) and is turned towards said dispensing mouth (4), an application of a pressure on said first foil (6) determining breaking of said second foil (7) for outflow and mixing of the first substance (3) and of the second substance (8) to form said product;

a bush (11) fitted onto or into said dispensing mouth (4); and a gasket (28) located between said bush (11) and said blistered capsule (6, 7).

21. A bottle (1) for extemporaneous-preparation products, including medicinal, pharmaceutical, cosmetic products, comprising:

a tank (2) with an inner volume that contains a first substance (3), the first substance being substantially liquid, the tank having a dispensing mouth (4);

a container (6, 7) with a containment cavity that contains a second substance (8), the second substance being substantially in powder, said container (6, 7) associable with said dispensing mouth (4) of said tank (2) with the containment cavity of said container (6, 7) being temporarily separated from the inner volume of said tank (2), said container (6, 7) being suited to be put in communication with the dispensing mouth (4) of said tank (2) for mixing the first substance (3) and the second substance (8) to form a product, wherein said container (6, 7) comprises a blistered capsule having:

a first foil (6) substantially deformable, a shape of the first foil (6) defining a shape of the containment cavity (9) of said second substance (8); and a second foil (7) substantially breakable and associated with said first foil (6) to close said containment cavity (9), the second foil (7) turned towards said dispensing mouth (4), an application of a pressure on said first foil (6) determining breaking of said second foil (7) for outflow and mixing of the first substance (3) and of the second substance (8) to form said product;

a pressing member (20) moving between i) a packaging configuration, wherein said pressing member (20) is kept substantially at a distance from said blistered capsule (6, 7), and ii) a release configuration, wherein said pressing member (20) is arranged in contact against said first foil (6) for breaking said second foil (7);

a removable cap (15) associable with said tank (2), said removable cap (15) covering said dispensing mouth (4) and said blistered capsule (6, 7);

a bush (11) fitted onto or into said dispensing mouth (4); and a joining element (18, 19) that stably connects said cap (15) to said bush (11), wherein said joining element (18, 19) comprise a retention tooth (18) obtained on an inner surface of said cap (15) and an interlocking projection (19) which protrudes from said bush (11).

* * * * *